US007232338B2

(12) United States Patent
Shen et al.

(10) Patent No.: US 7,232,338 B2
(45) Date of Patent: Jun. 19, 2007

(54) ELECTRICAL CONNECTOR WITH METAL STRENGTHEN MEMBER

(75) Inventors: Guo-Jian Shen, Kunshan (CN); Chi Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/593,231

(22) Filed: Nov. 6, 2006

(65) Prior Publication Data

US 2007/0105436 A1 May 10, 2007

(30) Foreign Application Priority Data

Nov. 4, 2005 (CN) ..... 2005 2 0077187

(51) Int. Cl.
*H01R 13/73* (2006.01)

(52) U.S. Cl. ..... 439/571

(58) Field of Classification Search ..... 439/571, 439/570, 572–573, 562–563, 607–610, 357, 439/660

See application file for complete search history.

(56) References Cited

U.S. PATENT DOCUMENTS

| | | | | |
|---|---|---|---|---|
| 5,704,808 | A | 1/1998 | Chishima | |
| 6,685,486 | B1 * | 2/2004 | Zhang et al. | 439/79 |
| 6,796,835 | B2 * | 9/2004 | Wu | 439/567 |
| 6,824,425 | B2 * | 11/2004 | Fan | 439/570 |
| 6,875,027 | B2 * | 4/2005 | Ye et al. | 439/74 |
| 7,001,212 | B1 * | 2/2006 | Juntwait | 439/566 |

* cited by examiner

*Primary Examiner*—J. F. Duverne
(74) *Attorney, Agent, or Firm*—Wei Te Chung

(57) ABSTRACT

An electrical connector comprises an insulated housing (1) defines a receiving cavity (10) and a pair of latching portions respectively formed at longwise ends thereof; a plurality of conductive terminals (2, 2') disposed in the housing and each has a contact portion exposed to the receiving cavity; a stuffer member (3) mounted to the housing and moving between an open position and a closed position; and a pair of metal strengthen member (4) mounted to the housing. The stuffer member comprises a main plate (31), a tongue plate (32) extending from a middle portion of the main plate and a pair of latching arms (33) extending from two longwise ends of the main plate to locate beside the tongue plate. Each latching arm has a latch (331) bending inward from its free end. The metal strengthen member has a stopping tab (42) cooperating with the latching portion to engage with the latch of the latching arm when the stuffer member in the open position.

11 Claims, 6 Drawing Sheets

ELECTRICAL CONNECTOR WITH METAL STRENGTHEN MEMBER

BACKGROUND OF THE INVENTION

1. Field of the Invention

The present invention relates to an electrical connector, and more particularly to an electrical connector for a sheet-like connection member such as a flexible printed circuit or a flexible flat cable.

2. Description of Related Art

U.S. Pat. No. 5,704,808 discloses a conventional connector adapted for connecting a flexible printed circuit (FPC). The FPC connector includes an insulated housing having a receiving cavity, a plurality of conductive terminals arranged and secured in the housing, a stuffer member mounted to the housing and a pair of fixing pieces respectively mounted to the lengthwise ends of the housing for securing the FPC connector to a printed circuit board. Each terminal has a contact arm exposed to the receiving cavity for contacting the FPC and a retention arm secured in the housing. The stuffer member has a tongue plate urging the FPC contacting with the contact arm of the terminal and a pair of latching arms respectively extending beside the tongue plate. Each latching arms has a latch extending inward from its free end. The housing further define a pair of passageways recessed inward from lateral surfaces thereof for accommodating the latching arms therein. Each passageway has a projection for engaging with the latch of the stuffer member when the stuffer member is in an open position to prevent the stuffer member breaking off the housing.

However, the housing and the stuffer member are generally made of plastic result that the latches and the projections do not have enough rigidity for bearing larger pulling force. That is, the latches and projections are easily distorted when receiving a larger pulling force. Therefore, the stuffer member is easily detached from the housing when it is pulled from a closed position to the open position.

Therefore, a new electrical connector is desired to overcome the disadvantage of the prior art connector.

SUMMARY OF THE INVENTION

An object of the present invention is to provide an electrical connector with a stuffer member which is firmly assembled thereon.

In order to achieve above-mentioned object, an electrical connector in accordance with the present invention comprises an insulated housing defines a receiving cavity and a pair of latching portions respectively formed at longwise ends thereof; a plurality of conductive terminals disposed in the housing and each has a contact portion exposed to the receiving cavity; a stuffer member mounted to the housing and moving between an open position and a closed position; and a pair of metal strengthen member mounted to the housing. The stuffer member comprises a main plate, a tongue plate extending from a middle portion of the main plate and a pair of latching arms extending from two longwise ends of the main plate to locate beside the tongue plate. Each latching arm has a latch bending inward from its free end. The metal strengthen member has a stopping tab cooperating with the latching portion to engage with the latch of the latching arm when the stuffer member in the open position.

Other objects, advantages and novel features of the present invention will become more apparent from the following detailed description of the present embodiment when taken in conjunction with the accompanying drawings.

DETAILED DESCRIPTION OF THE INVENTION

Figure 1:
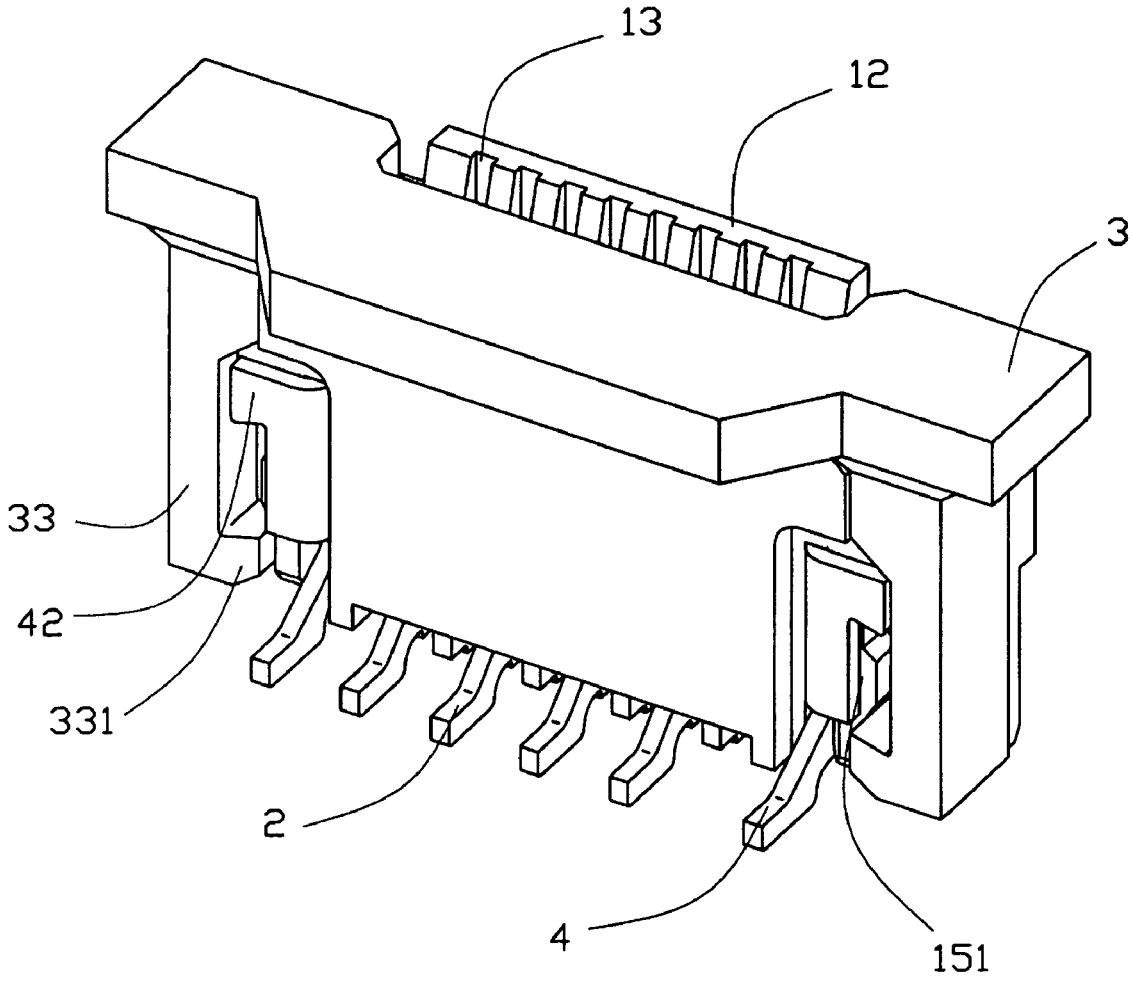
FIG. 1 is an assembled perspective view of an electrical connector in accordance with the present invention, wherein a stuffer member of the electrical connector in a closed position.

Reference will now be made to the drawing figures to describe the preferred embodiment of the present invention in detail.

Figure 2:
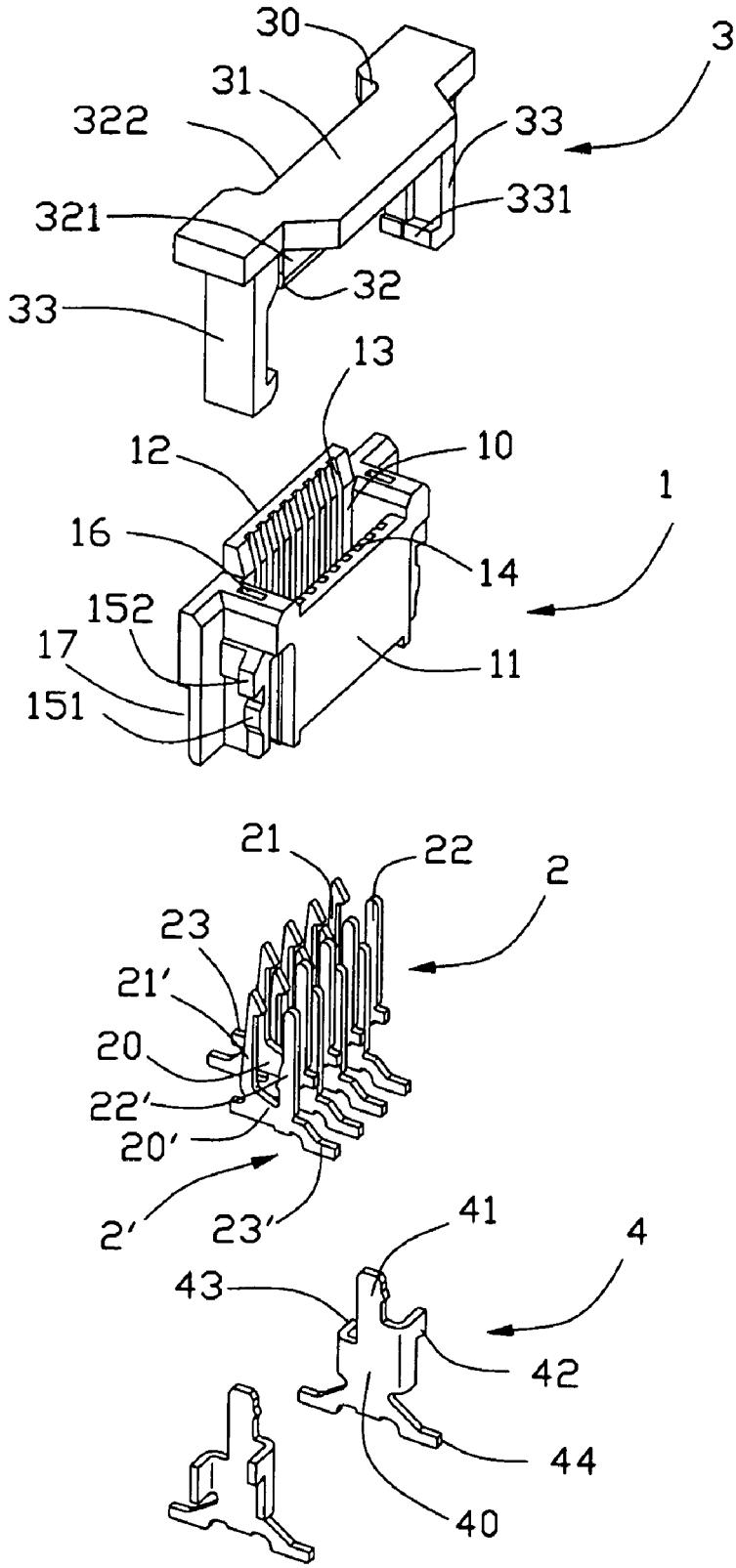
FIG. 2 is an exploded perspective view of the electrical connector shown in FIG. 1.

Referring to FIGS. 1 and 2, an electrical connector in accordance with the present invention is provided. The electrical connector comprises an insulated housing 1, a plurality of conductive terminals, a stuffer member 3 assembled to the housing 1 and a pair of metal strengthen member 4 respectively assembled to longwise ends of the housing 1

The housing 1 is substantially rectangular shape and comprises a front wall 11, a rear wall 12 located oppositely to and extending parallel to the front wall 11 and a pair of lateral walls connecting the front wall 11 and the rear wall 12 together. Said four end-to-end walls are all vertical standing so as to form an upward-opening receiving cavity 10. The front wall 11 and the rear wall 12 extending in a longitudinal direction and respectively define a plurality of terminal receiving channels 14, 13 communication with the receiving cavity 10. The rear wall 12 extends longer than the front wall 11 in the longitudinal direction, and each of extended portions formed longwise ends of the rear wall 12 defines a recess 17. Each lateral wall defines a groove 16 extending therethrough in a vertical direction perpendicular to the longitudinal direction. The housing 1 further comprises a pair of latching portions respectively extending outward from the corresponding lateral walls. Each latching portion comprises a first projection 151 and a second projection 152 spacing from the first projection 151 in the vertical direction.

Figure 6:
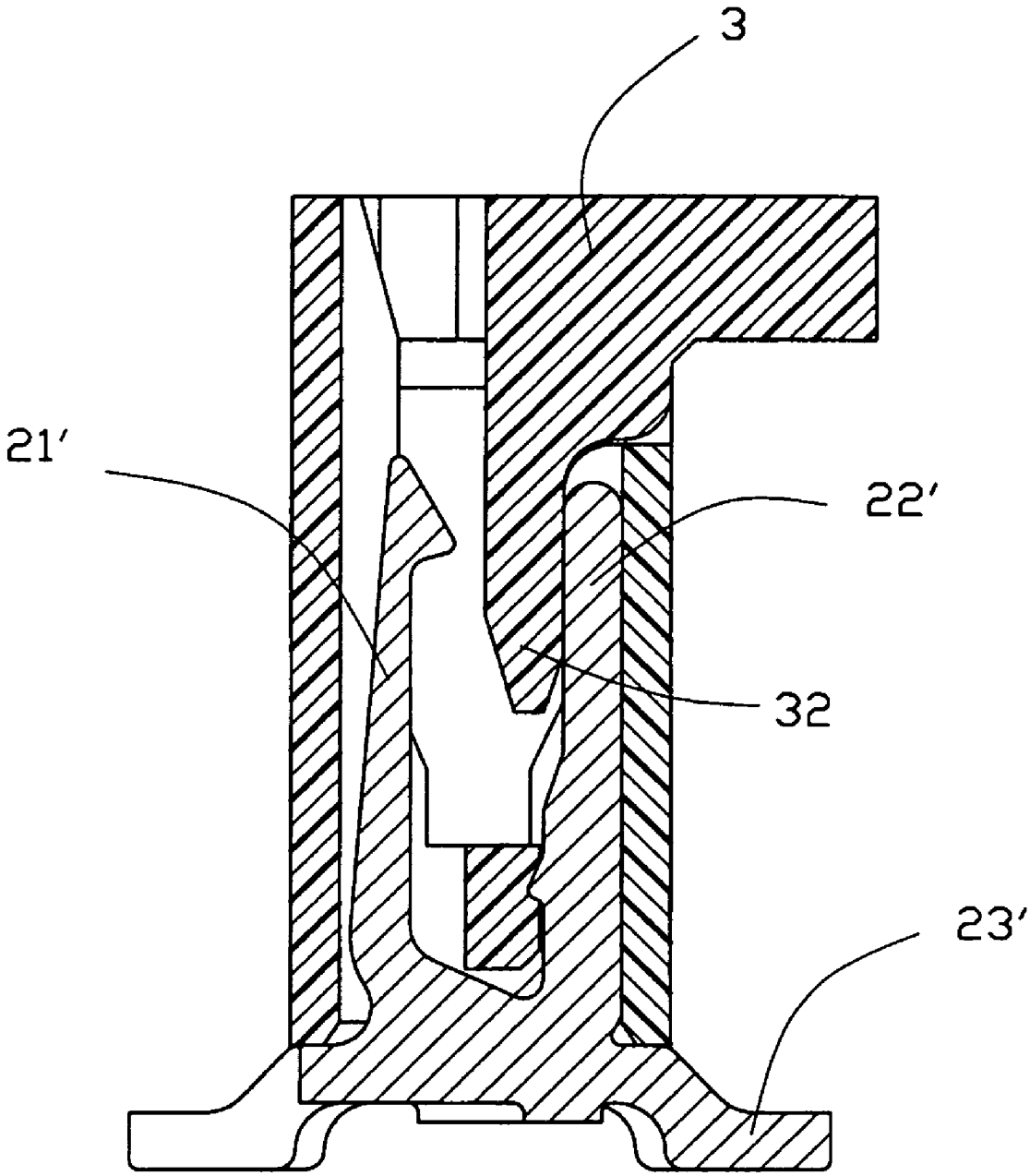
FIG. 6 is a cross-section view of the electrical connector, taken along the line 6—6 of FIG. 5.

Said conductive terminals are divided into first terminals 2 and second terminals 2'. Each of the first terminals 2 and the second terminals 2' comprises a support portion 20, 20', a contact beam 21, 21' extending upward from one end of the support portion 20, 20', a retention beam 22, 22' extending upward from the other end of the support portion 20, 20' and a solder leg 23, 23' extending downward from the support portion 20, 20'. The sole difference between the first contact 2 and the second contact 2' is the location of the solder legs 23, 23'. The solder legs 23 of the first terminals 2 extend close to the contact beams 21, while the solder legs 23' of the second terminals 2' extend oppositely to the solder legs 23 and located close to the retention beam 22. In addition, the first and second terminals 2, 2' are alternatively assembled in the housing 2 from bottom in the vertical direction so that the distance between the solder legs 23, 23' is large enough to facilitate the solder legs 23, 23' connecting onto a printed circuit board and preferably avoid taking place short circuit. Further referring to FIG. 6, the contact beams 21, 21' are inserted into the terminal channels 13 defined on the rear wall 12 and each has a contact portion exposing to the receiving cavity 10, and the retention beams 22, 22' are retained in the terminal channels 14 defined on the front wall 11 so as to firmly assemble the terminals 2, 2' to the housing 1.

Figure 4:
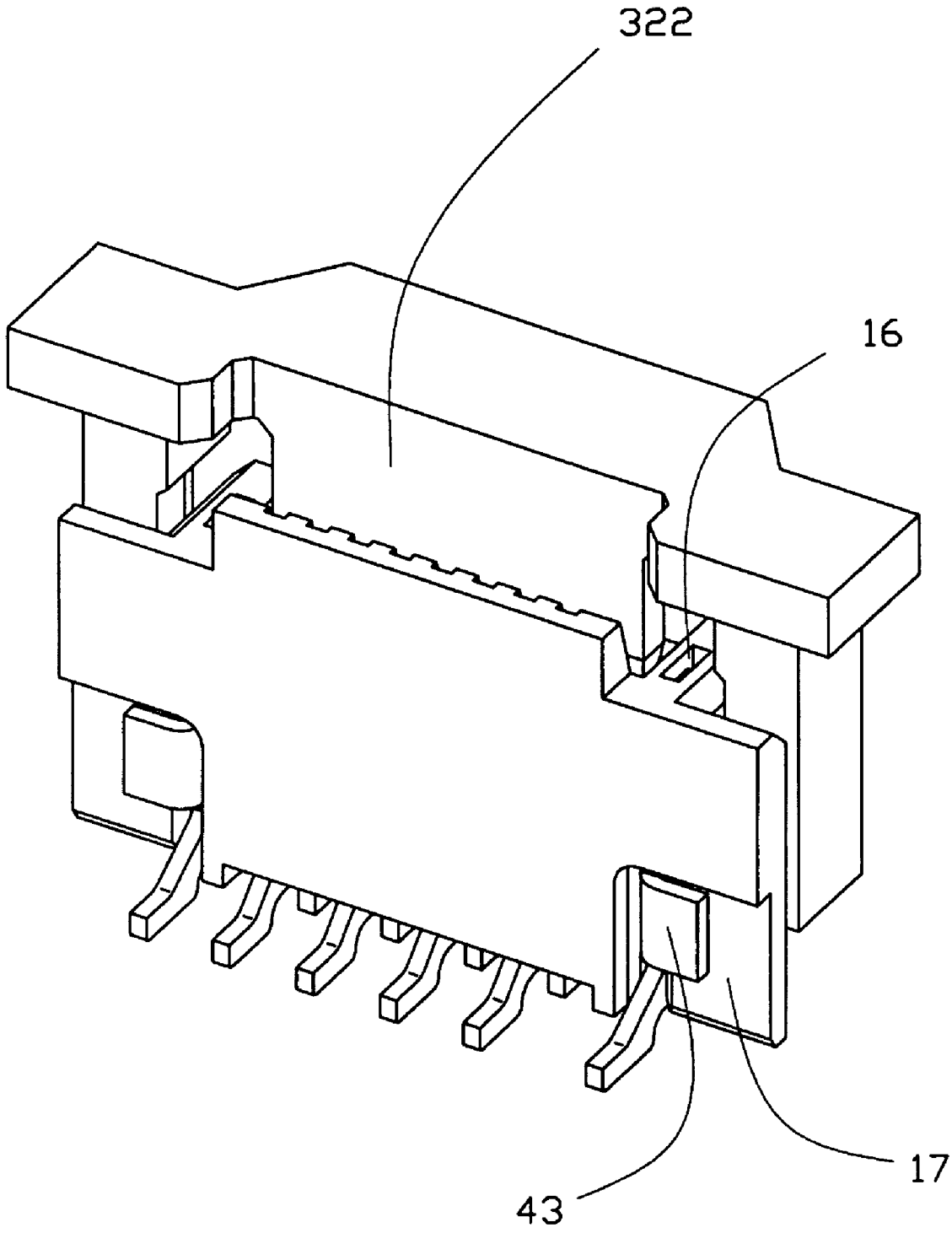
FIG. 4 is a similar view of FIG. 3, but taken from another aspect.
Figure 5:
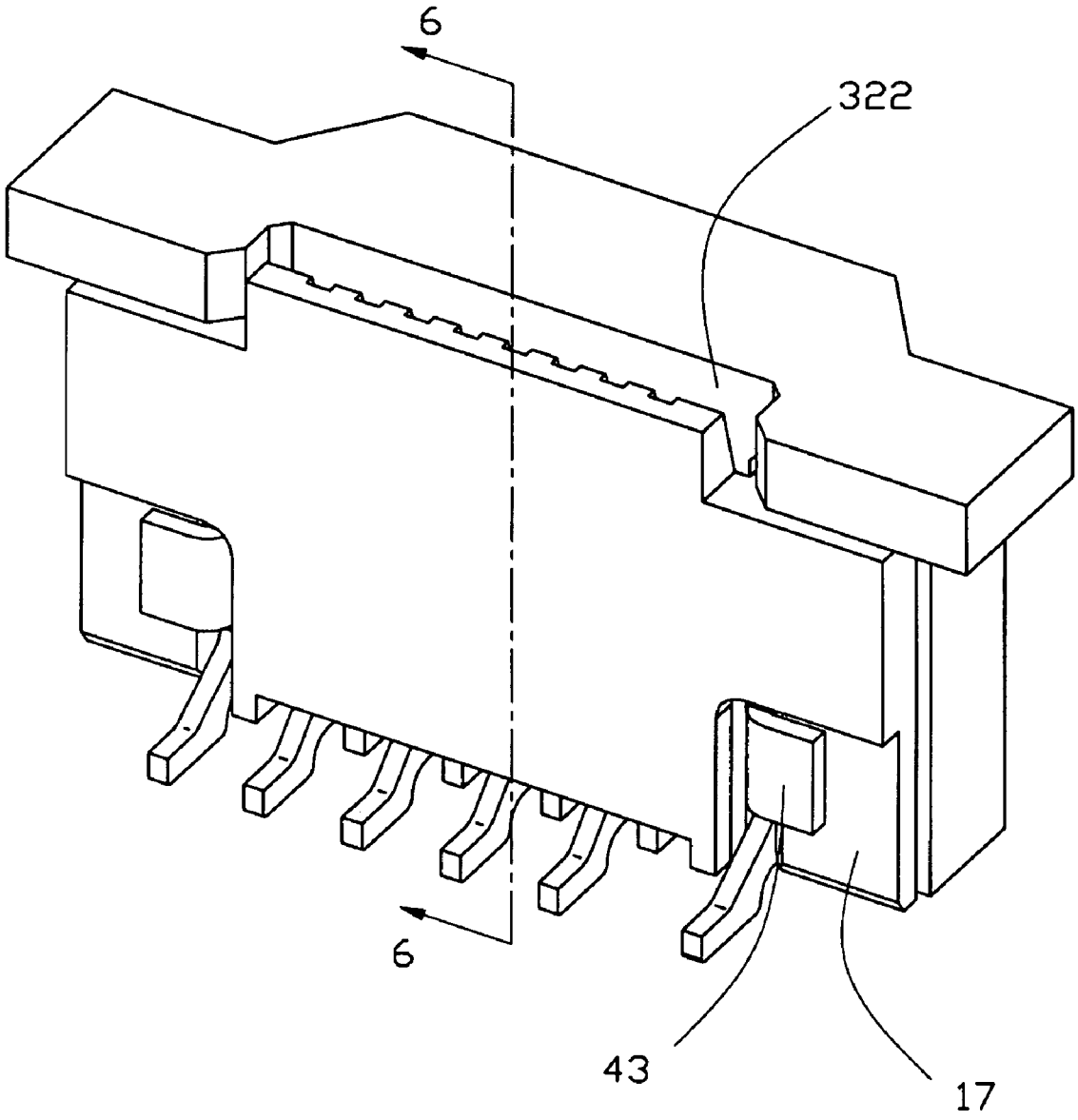
FIG. 5 is a similar view of FIG. 4, wherein the stuffer member in the closed position.

Referring to FIGS. 2 and 4, the stuffer member 3 has a main plate 31, a tongue plate 32 extending downward from a middle portion of the main plate 31 and a pair of latching arms 33 extending downward from two longwise ends of the main plate 31 to be located beside the tongue plate 32. The main plate 31 has a guiding mouth 30 for guiding a sheet-like connection member (not shown) such as a flexible printed circuit and a flexible flat cable inserted into the receiving cavity 10. The tongue plate 32 has a front surface 321 adjacent to the retention arms 22, 22' and a rear surface 322 pressing the connection member to contact with the contact portions of the terminals 2, 2'. Each latching arm has a latch 331 bending inward from its free end for engaging with the latching portion of the housing 1 when the stuffer member 3 mounted to the housing 1.

Figure 3:
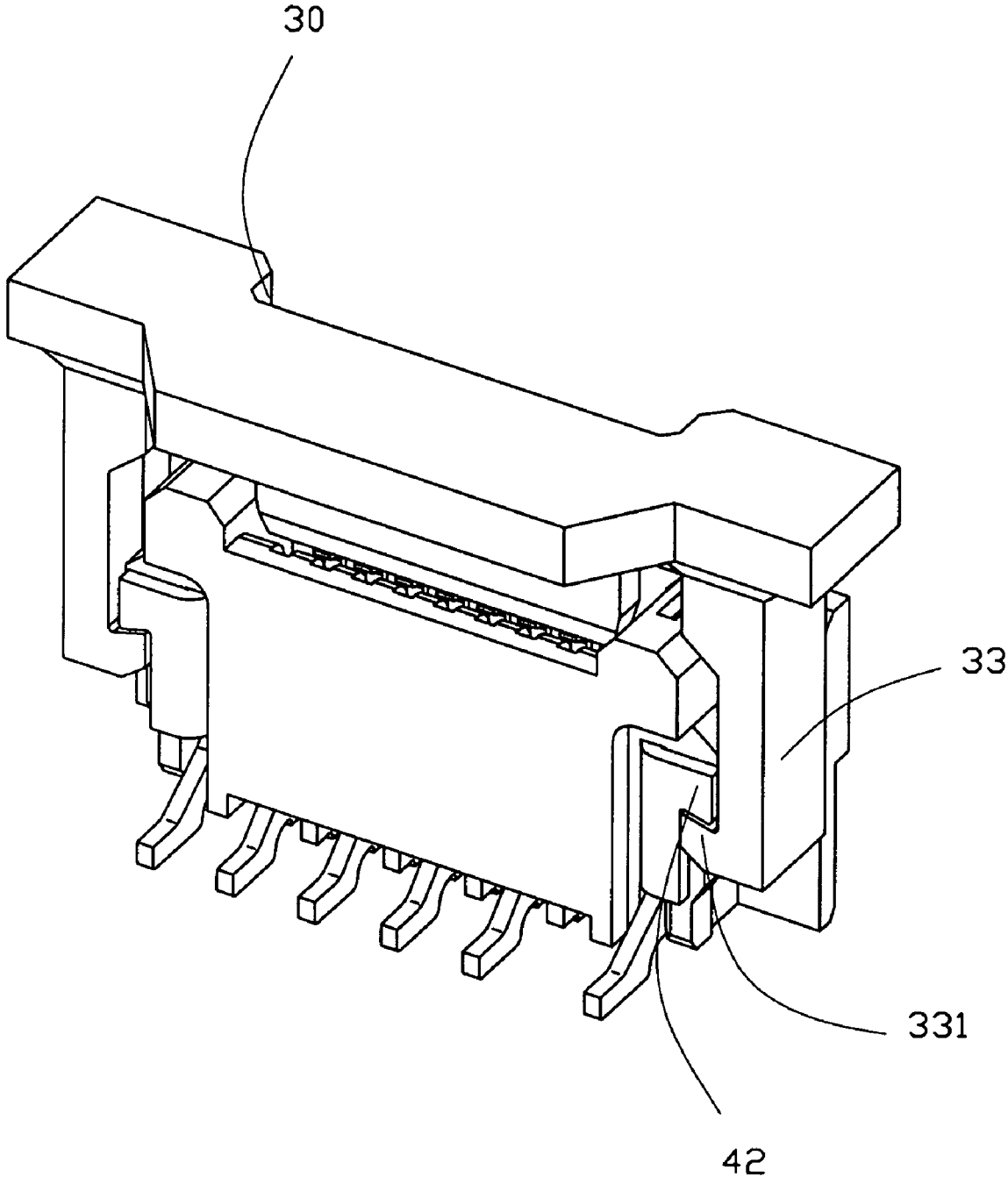
FIG. 3 is a similar view of FIG. 1, wherein the stuffer member in an open position.

Each of the metal strengthen member 4 comprises a main portion 40, a fixed tab 41 extending upward from a top edge of the main portion 40 to be retained in the grooves 16, a clasping tab 43 extending from a rear edge of the main portion 40 in the longitudinal direction to be received in the recess 17 for clasping the rear wall 12, a stopping tab 42 extending from a front edge of the main plate 40 in the same direction as the clasping tab 43 and a pair solder legs 44 extending oppositely from a bottom edge of the main plate 40. The stopping tab 42 is a substantially reversed L-shaped viewed from front aspect and has a head portion and a slim portion. When the metal strengthen members 4 completely assembled onto the lengthwise ends of the housing 2, The head portion of each stopping tab 42 substantially covers the corresponding the second projection 152 viewed from front aspect so that the head portion cooperates with the projection 152 to engage with the latch 331 when the stuffer member 3 is pulled into an open position (shown in FIGS. 3 and 4).

Referring to FIGS. 2, 3, 4 and 5, after assembling the conductive terminals 2, 2' to the housing, the strengthen members 4 are respectively mounted to the longwise ends of housing 1. Then the stuffer member 3 is mounted to the housing 1 to be in the open position, when the latches 331 engage with the second projections 152 of the housing 1 and the stopping tabs 42 of the strengthen members 4. The sheet-like connection member is inserted into the receiving cavity 10 guiding by the guiding mouth 30, and then the stuffer member 3 is continually pushed downward until the latches 331 fasten onto the first projections 151, that is, the stuffer member 3 arrives at a closed position (shown in FIGS. 1, 5 and 6). The tongue plate 32 urges the sheet-like connection member to electrically contact with the contact portions of the conductive terminals 2, 2'.

It is note that the stopping tab 42 cooperates with the second projection 152 to engage with the latch 331 of the stuffer member 3 when the stuffer member 3 is pulled into the open position. Therefore, the stuffer member 3 can firmly engage with the housing 1 although sometime the stuffer member 3 endures unexpectedly enlarged pulling force.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulated housing defines a receiving cavity and a pair of latching portions respectively formed at longwise ends thereof;

a plurality of conductive terminals disposed in the housing and each has a contact portion exposed to the receiving cavity;

a stuffer member mounted to the housing and moving between an open position and a closed position, the stuffer member comprising a main plate, a tongue plate extending from a middle portion of the main plate and a pair of latching arms extending from two longwise ends of the main plate to be located beside the tongue plate, and each latching arm having a latch bending inward from its free end; and a pair of metal strengthen member mounted to the housing and each has a stopping tab corresponding to the latching portion to engage with the latch of the latching arm when the stuffer member is in the open position.

2. The electrical connector as claimed in claim 1, wherein the stopping tab cooperates with the latching portion to engage with the latch of the latching arm when the stuffer member is in the open position.

3. The electrical connector as claimed in claim 2, wherein the latching portion comprises a first projection for engaging with the latch of the latching arm when the stuffer member is in the closed position and a second projection cooperating with the stopping tab to engage with the latch of the latching arm when the stuffer member is in the open position.

4. The electrical connector as claimed in claim 1, wherein the metal strengthen member has a main portion, and the stopping tab extends from one edge of the main portion.

5. The electrical connector as claimed in claim 4, wherein the metal strengthen member has a clasping tab extending from another edge of the main portion and substantially parallel to the stopping tab for fastening onto the housing.

6. The electrical connector as claimed in claim 4, wherein the metal strengthen member has fixed tab extending from the main portion and perpendicularly to the stopping tab, and the housing further defines a groove for retaining the fixed tab therein.

7. The electrical connector as claimed in claim 4, wherein the metal strengthen member has a pair of solder legs which extending oppositely from the main portion.

8. The electrical connector as claimed in claim 1, wherein said conductive terminals are divided into first terminals and second terminals, and the first and second terminal are alternatively assembled into the housing.

9. The electrical connector as claimed in claim 8, wherein each of the first terminal and the second terminal has a solder leg for connecting to a printed circuit board, and the solder legs of the first terminals are opposite to the solder legs of the second terminals with respect to the housing.

10. The electrical connector as claimed in claim 1, wherein the stopping tab is arranged in a reversed L-shape.

11. An electrical connector comprising:

an insulated housing defines a receiving cavity and a pair of latching portions respectively formed at longwise ends thereof;

a plurality of conductive terminals disposed in the housing and each has a contact portion exposed to the receiving cavity;

a stuffer member mounted to the housing and moving between an open position and a closed position during along an insertion or withdrawal direction, the stuffer member comprising a main body, a pair of latching arms extending from two longwise ends of the main plate, and each latching arm having a latch around a free end thereof; and a pair of metal strengthen member mounted to the housing and each has a stopping tab corresponding to the latching portion to engage with the latch of the latching arm to prevent further movement of said stuffer member away from the open position in the withdrawal direction when the stuffer member is in the open position.

* * * * *